US008419398B2

(12) United States Patent
Kothnur et al.

(10) Patent No.: US 8,419,398 B2
(45) Date of Patent: Apr. 16, 2013

(54) METHOD AND APPARATUS FOR MANAGING FLUID FLOW WITHIN A SCREW PUMP SYSTEM

(75) Inventors: Vasanth Kothnur, Clifton Park, NY (US); David Deloyd Anderson, Glenville, NY (US); Farshad Ghasripoor, Glenville, NY (US); Michael V. Drexel, Delanson, NY (US); Thomas Steen, Ballston Spa, NY (US); Hrishikesh Vishvas Deo, Guilderland, NY (US)

(73) Assignee: General Electric Company, Niskayuna, NY (US)

( * ) Notice: Subject to any disclaimer, the term of this patent is extended or adjusted under 35 U.S.C. 154(b) by 750 days.

(21) Appl. No.: 12/433,515

(22) Filed: Apr. 30, 2009

(65) Prior Publication Data

US 2010/0278673 A1 Nov. 4, 2010

(51) Int. Cl.
*F03C 2/00* (2006.01)
*F03C 4/00* (2006.01)
*F04C 2/00* (2006.01)

(52) U.S. Cl.
USPC ..... 418/202; 418/98; 418/102; 418/152; 417/366

(58) Field of Classification Search ..... 418/201.1, 418/202, 98, 152, 102; 417/366
See application file for complete search history.

(56) References Cited

U.S. PATENT DOCUMENTS

| | | | | |
|---|---|---|---|---|
| 3,391,643 | A | 7/1968 | Zalis | |
| 3,402,670 | A | 9/1968 | Boyd | |
| 4,462,769 | A * | 7/1984 | Schibbye et al. | 418/98 |
| 4,872,808 | A | 10/1989 | Wilson | |
| 5,624,249 | A * | 4/1997 | Rohlfing | 418/102 |
| 5,738,505 | A * | 4/1998 | Mezzedimi et al. | 418/102 |
| 6,398,493 | B1 | 6/2002 | Chien et al. | |
| 6,457,950 | B1 | 10/2002 | Cooper et al. | |
| 7,569,097 | B2 * | 8/2009 | Campen et al. | 95/243 |

FOREIGN PATENT DOCUMENTS

| | | | | |
|---|---|---|---|---|
| DE | 1201686 | B | 9/1965 | |
| DE | 102006061971 | A1 | 6/2008 | |
| JP | 56038595 | A * | 4/1981 | 418/98 |
| WO | WO9103647 | A1 | 3/1991 | |

OTHER PUBLICATIONS

PCT International Search Report dated Jan. 17, 2011 and Written Opinion.

* cited by examiner

*Primary Examiner* — Theresa Trieu
(74) *Attorney, Agent, or Firm* — Andrew J. Caruso

(57) ABSTRACT

In a pump system, a process fluid is directed into inlet chambers of a pump casing at an inlet pressure, and a plurality of rotors disposed inside the pump casing are rotated to pump the process fluid from the inlet chambers to an outlet chamber located between the inlet chambers, wherein the process fluid in the outlet chambers is at an outlet pressure. The process fluid is directed from the outlet chamber to a separator configured to separate particulate matter from the process fluid, and a portion of separated process fluid is directed from the separator to a gear chamber of the pump. Pump bearings are lubricated with the portion of separated process fluid from the gear chamber. Some of the portion of the separated process fluid from the pump bearing is leaked to the inlet chambers via rotor shrouds to reduce accumulation of particulate matter in the inlet chambers.

7 Claims, 9 Drawing Sheets

METHOD AND APPARATUS FOR MANAGING FLUID FLOW WITHIN A SCREW PUMP SYSTEM

BACKGROUND OF THE INVENTION

The embodiments disclosed herein relate generally to a screw pump, and more particularly to lubrication and process fluid management of a multiphase screw pump.

Screw pumps are rotary, positive displacement pumps that use two or more screws to transfer high or low viscosity fluids or fluid mixtures along an axis. In an embodiment, a twin screw pump may have two intermeshing counter-rotating rotor screws. The volumes or cavities between the intermeshing screws and a liner or casing transport a specific volume of fluid in an axial direction around threads of the screws. As the screws rotate the fluid volumes are transported from an inlet to an outlet of the pump. In some applications, twin screw pumps are used to aid in the extraction of oil and gas from on-shore and sub-sea wells. Twin screw pumps lower the back pressure on the reservoir and thereby enable greater total recovery from the reservoir.

In many cases, the twin screw pump may be used to pump a multiphase fluid from a sub-sea well which may be processed to produce the petroleum products. Accordingly, twin screw pumps may be configured to prevent the flow of process fluids into the bearings, timing gears, motor, environment, or the like. In particular, twin screw pumps may utilize a shaft seal on each end of each rotor, thereby requiring four seals in total. The shaft seals also typically require the usage of a lubricant flush system that maintains the rub surfaces of the sealing system clean and removes heat from the sealing surfaces.

Further, in the example the system used to lubricate the various parts of the twin screw pump system, including bearings coupled to the rotor screws, may require additional components and maintenance. This separate lubrication system adds costs and maintenance to the screw pump system.

BRIEF DESCRIPTION OF THE INVENTION

In accordance with certain aspects of the invention, a pump system includes inlet chambers, an outlet chamber, and a plurality of rotors disposed inside the inlet chambers and the outlet chamber to pump a multiphase process fluid from the inlet chambers to the outlet chamber. Pump bearings are disposed adjacent to each inlet chamber. A shroud is disposed around each rotor in each inlet chamber adjacent to a respective bearing. A gear chamber is configured to receive a portion of the multiphase process fluid and to circulate the portion of the multiphase process fluid through the pump bearings to lubricate the pump bearings. The shrouds are configured to permit some of the portion of the multiphase process fluid to leak through the pump bearings to reduce accumulation of particulate matter in the inlet chambers.

The invention also provides a method for operating a pump system, comprising directing a process fluid into inlet chambers of a pump casing at an inlet pressure, and rotating a plurality of rotors disposed inside the pump casing to pump the process fluid from the inlet chambers to an outlet chamber located between the inlet chambers, wherein the process fluid in the outlet chambers is at an outlet pressure. The process fluid is directed from the outlet chamber to a separator configured to separate particulate matter from the process fluid, and a portion of separated process fluid is directed from the separator to a gear chamber of the pump. Pump bearings are lubricated with the portion of separated process fluid from the gear chamber. Some of the portion of the separated process fluid from the pump bearing is leaked to the inlet chambers via rotor shrouds to reduce accumulation of particulate matter in the inlet chambers.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
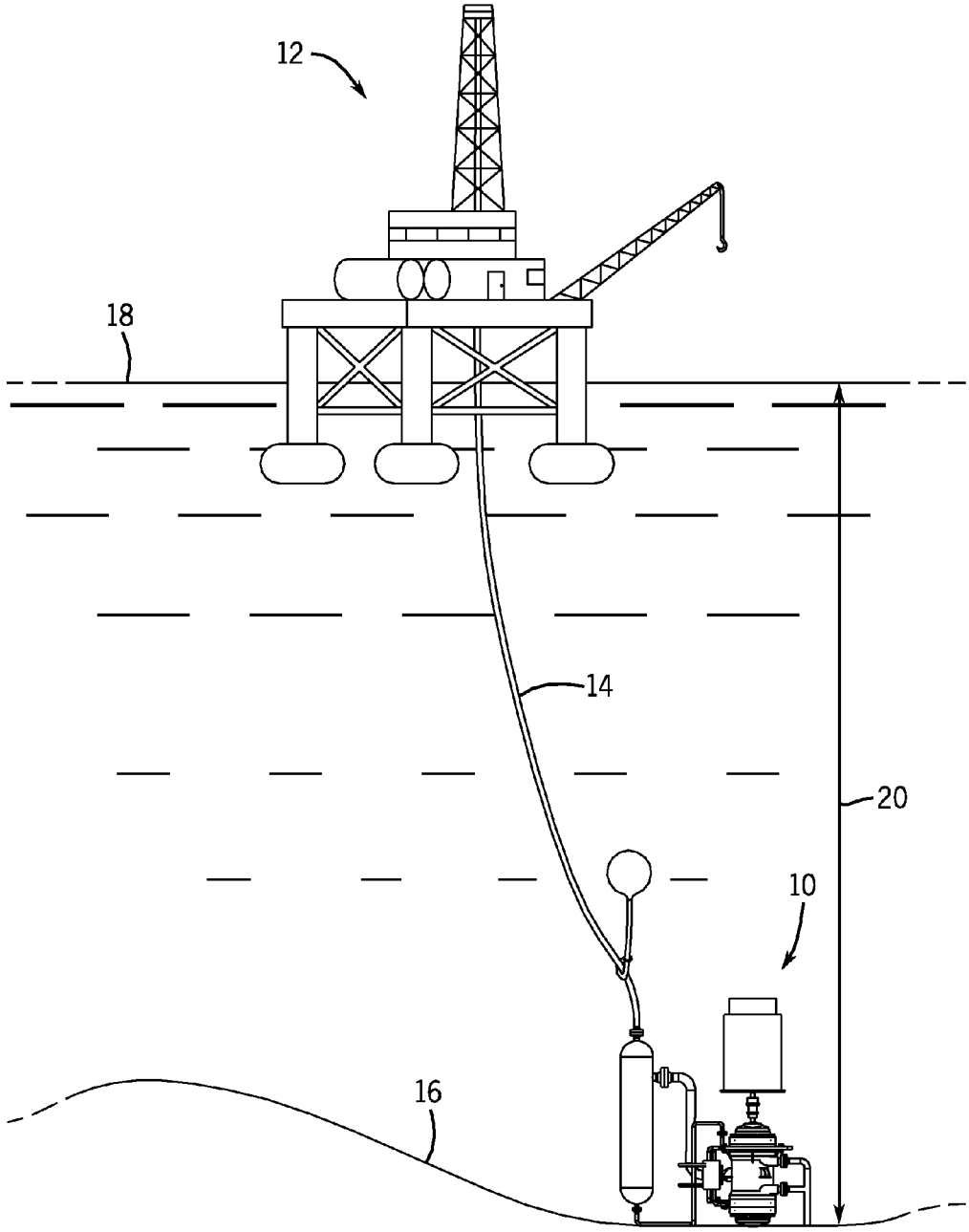
FIG. 1 is a diagrammatical representation of a screw pump system and a production platform in accordance with an embodiment of the present technique.

FIG. 1 is a schematic diagram of a screw pump system 10 that may be provided with a production platform 12 to pump a fluid for processing, storage and/or transport. As depicted, the screw pump system 10 may be connected to the production platform 12 via a conduit or riser 14 that may be used to route a process fluid to the platform. The process fluid may be a multiphase fluid, such as raw petroleum based fluid from a sub-sea drilling rig. In addition, the screw pump system 10 may be located on a sea or ocean floor 16, wherein the screw pump system 10 pumps the process fluid to a production platform floating on an ocean surface 18, or anchored to the sea floor. As depicted, the screw pump system 10 may be located a distance 20 from the production platform 12, wherein the pump is used to create the pressure and force needed to pump the process fluid to the surface 18. In another embodiment, the screw pump system 10 may be located in a factory or chemical plant and may be configured to direct a multiphase process fluid to holding tanks or other structures for processing or storage. In the illustrated example, the screw pump system 10 may be useful during the extraction of oil and/or gas from sub-sea wells, to reduce back pressure and assist in the extraction of the oil and/or gas. In the depicted embodiment, the screw pump system 10 uses two intermeshing screws to pump the process fluid. In the example, the screw pump may be referred to as a twin screw pump.

The screw pump system 10 includes several components that may require lubrication and may be susceptible to wear and tear due to exposure to particulate matter within the process fluid. Specifically, the screws within the screw pump system 10 may be coupled to bearings that require lubrication in order to perform properly and avoid breakdown. Moreover, in some embodiments, the lubrication system may require a separate set of components and lubricants in order to properly lubricate the pump. As depicted, the lubrication of pump bearings may be achieved by routing the multiphase process fluid through a circuit of conduits and a system for separating particulates from the process fluid. The process fluid may lubricate the components within the screw pump system 10 after the process fluid has been treated, routed and directed to locations within the screw pump system 10 to make it suitable for lubrication of the pump components. Moreover, the particulates located in the multiphase process fluid pumped by the screw pump system 10 may cause damage to components within the screw pump system 10 if the particulates are allowed to settle in certain locations. Accordingly, as discussed below, embodiments include gears that may be used to grind the particulate matter to crush it, reducing the size of the particulate matter within the process fluid, thereby making it suitable for lubrication of the components and rotors within the screw pump system 10.

Figure 2:
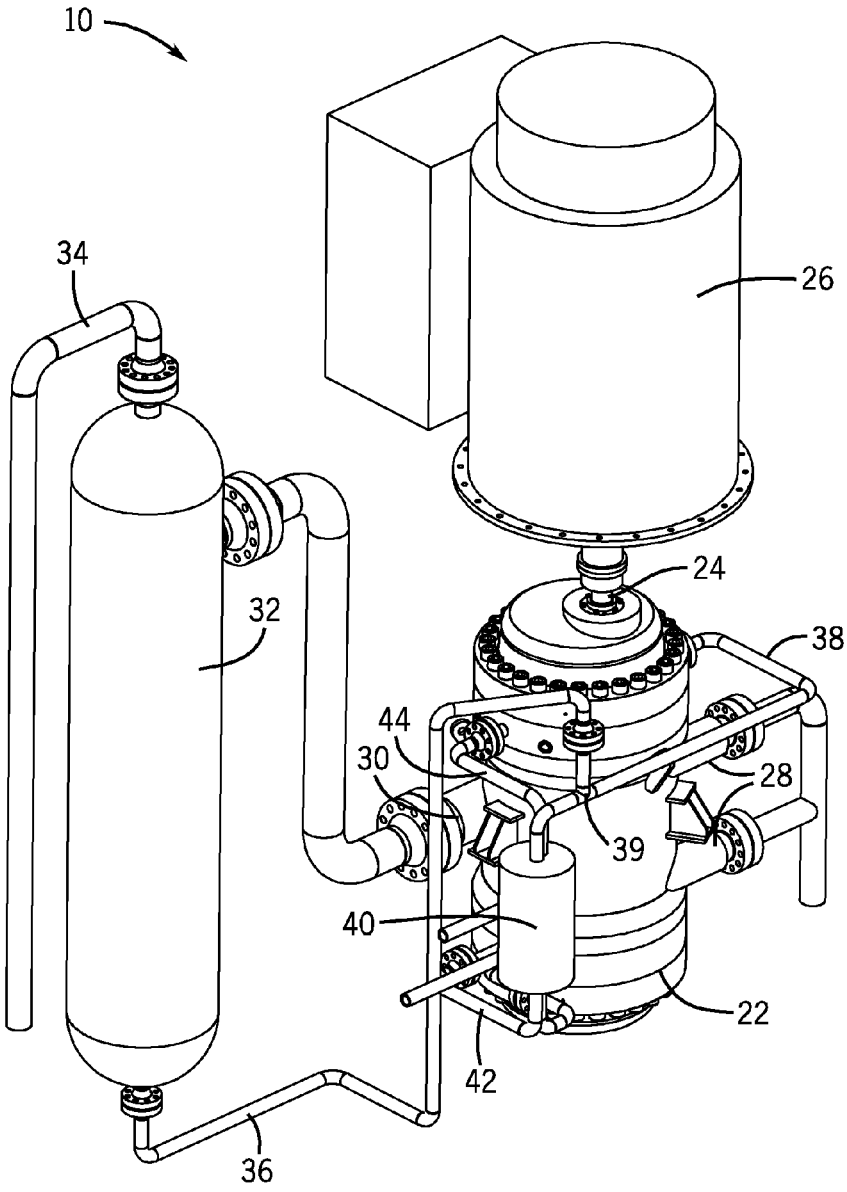
FIG. 2 is a perspective view of a screw pump system, as shown in FIG. 1, including a separator, in accordance with an embodiment of the present technique.

FIG. 2 is a detailed perspective view of an embodiment of the screw pump system 10. As depicted, the screw pump system 10 includes a twin screw pump 22, which includes two screws or rotors used to direct a process fluid at a high pressure to a downstream location. In other embodiments, the screw pump 22 may include more than two screws that intermesh to pump a process fluid. One of the screws may be coupled to a driving shaft 24, which may be coupled to a motor 26. The motor 26 and the driving shaft 24 produce a rotational output used to drive a driving rotor that is coupled, via a gear, to drive a driven rotor, thereby producing the necessary pressure and force to direct the process fluid downstream. The process fluid, such as a petroleum based multiphase fluid, may enter the twin screw pump 22 via fluid intakes 28. By rotating the meshing threads of the rotor screws, the process fluid is driven from the twin screw pump 22 via a fluid outlet 30. The fluid output may be directed to a conduit and thereby to a separator 32. The separator 32 may be configured to remove a portion of particulates from the multiphase process fluid. Further, the separator 32 may also be configured to reduce a gas content of the multiphase process fluid, thereby increasing the liquid portion of the process fluid. Alternatively, the separator 32 may be configured to remove a liquid portion of the process fluid to direct a gas portion of the process fluid downstream via a conduit 34. As depicted, the conduit 34 may be routed to a downstream device or unit, such as the production platform 12 or another processing unit. The separator 32 may be configured to direct a portion of the separated process fluid downstream via conduit 34 while directing another portion of the separated process fluid to a conduit 36 which may be used to re-circulate the separated multiphase process fluid.

In the depicted embodiment, the separated multiphase process fluid directed through conduit 36 may be joined with process fluid directed via conduit 38 from an end chamber of the screw pump system 10. As depicted, the joining of flow from conduits 36 and 38, via a joint 39, may be routed to a chamber 40 for processing. For example, chamber 40 may be used to cool the circulating lubrication flow to be routed via a conduit 42 to an end chamber of the twin screw pump 22. As depicted, the re-circulation flow of a portion of the separated process fluid directed via conduit 36 is used along with a flow directed via conduit 38 to re-circulate the process fluid throughout the screw pump system 10 in order to lubricate components within the system and reduce particulates within the process fluid. As described in detail below, the conduits and fluid circuits may be utilized to reduce settling of particulates within the process fluid, thereby reducing downtime and wear of the screw pump system 10 components. In addition, conduit 44 may be used to circulate process fluid between the end chambers of the twin screw pump 22, wherein the conduit 44 directs a separated multiphase process fluid to lubricate pump bearings, thereby insuring smooth operation of the twin screw pump 22.

Figure 3:
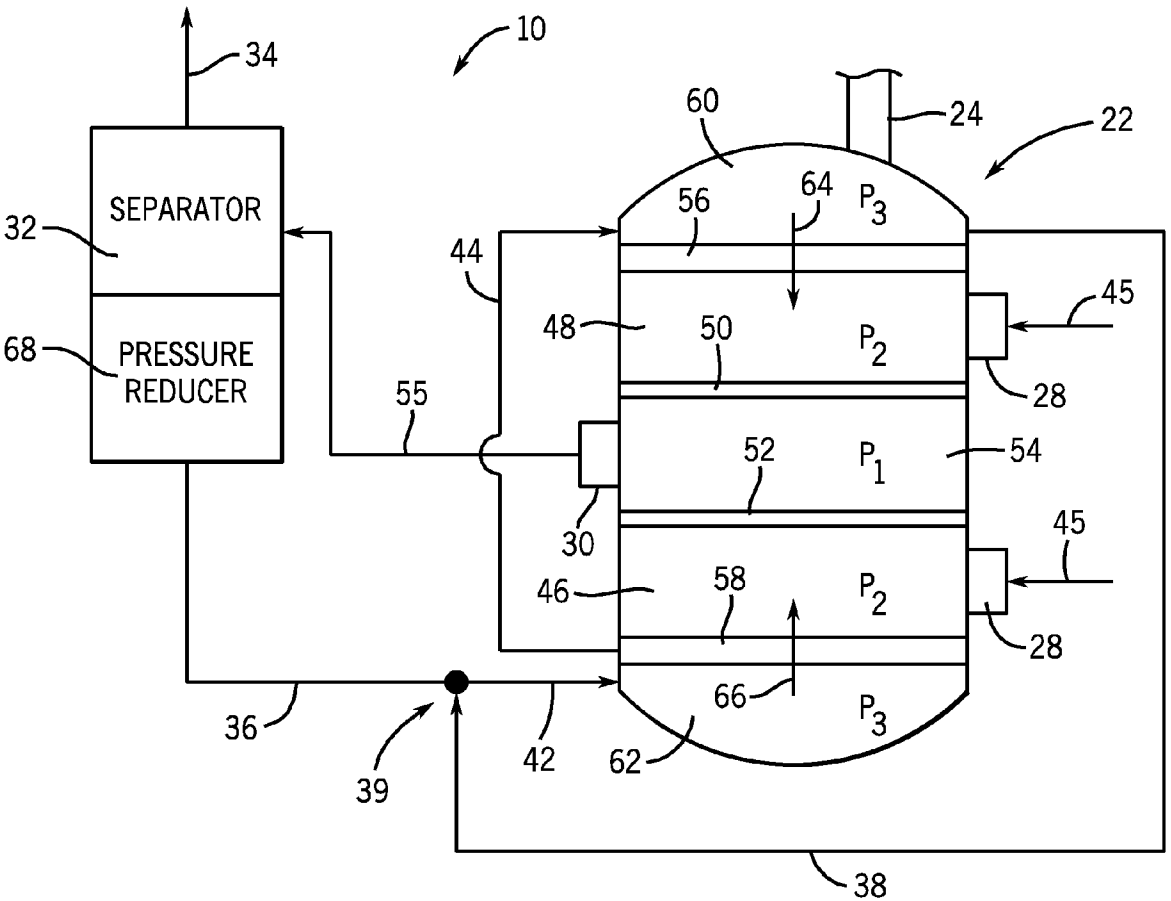
FIG. 3 is a schematic diagram of a screw pump system, as shown in FIG. 2, including a system for separating and directing process fluid throughout the screw pump assembly, in accordance with an embodiment of the present technique.

FIG. 3 is a schematic diagram of the screw pump system 10 including conduits that are used for fluid communication between portions of the screw pump system 10. Specifically, the configuration, flow, pressure, processing and orientation of the conduits and chambers within the screw pump system 10 enable the system to be lubricated by the process fluid while reducing particulates or contaminants within the process fluid to improve the pumping operation. As illustrated, the twin screw pump 22 includes fluid intakes 28 which direct the process fluid flow 45 to inlet chambers 46 and 48. The inlet chambers 46 and 48 are configured to receive process fluid and are encompassed by rigid structures or walls, such as bulkhead separators 50 and 52. Further, an outlet chamber 54 is located between the inlet chambers 46 and 48. The outlet chamber 54 is separated from the inlet chambers 46 and 48 by the bulkheads 50 and 52, which enable the management of pressure within and between the respective chambers. The outlet chamber 54 may be configured to direct the multiphase process fluid out through the fluid outlet 30 as the process fluid outflow 55 is directed to the separator 32. In addition, the inlet chambers 46 and 48 may also surrounded by barriers such as upper radial bearing flange 56 and lower radial bearing flange 58.

The barriers, including bearing flanges 56 and 58, as well as bulkheads 50 and 52, enable the inlet chambers 46 and 48 to be separated from the adjacent outlet and end chambers, thereby enabling fluid flow and pressure management. As depicted, an upper end chamber 60 may be coupled to the upper radial bearing flange 56. Similarly, a lower end chamber 62 is coupled to the lower radial bearing flange 58. The end chambers 60 and 62 may each contain pump bearings, to enable smooth rotation of the screws within the twin screw pump 22. The pump bearings are lubricated by re-circulated process fluid and conduits of the pump system 10. For example, the upper end chamber 60 may include a first set of pump bearings, wherein each bearing is coupled to the upper ends of each of the rotor screws. Further, the lower end chamber 62 may contain a second set of pump bearings coupled to the lower ends of the rotor screws. The bearings may be any suitable bearings to facilitate shaft rotation, such as journal bearings. For example, journal bearings may support the rotor shaft where the shaft, also known as a journal, may turn in a bearing with a layer of oil or lubricant separating the two parts through fluid dynamic effects. In an example, the lubricant used for the journal bearing may be process fluid with reduced particulate matter.

The lower end chamber 62 may also include a pair of gears, wherein each gear is coupled to an end of the rotor. The gears transfer force and power from the driving rotor to the driven rotor and may be referred to as timing gears. As will be described in detail below, the gears may be utilized for crushing of particulates within the process fluid as the process fluid flows through the gears, thereby enabling the process fluid to be suitable for lubrication of the pump bearings. After crushing of the particulates within the process fluid, the process fluid may be routed to lubricate the pump bearings within the end chambers 60 and 62. Thus, the gears serve not only to transfer mechanical energy between the rotors, but to pump the lubricating fluid, and to grind any particulate in the fluid to an acceptable size for lubrication and wear avoidance. For example, the separated multiphase process fluid may flow into the joint 39, wherein the flow in conduit 38 joins the separated multiphase process fluid to form a combined flow 42 into the lower end chamber 62. Upon flowing into the lower end chamber 62, the entire portion of process fluid may flow through the gears which are configured to crush the particulates, thereby reducing the particulate size within the process fluid. After crushing of the particulates, the multiphase process fluid may be routed to lubricate the pump bearings within the lower end chamber 62. Further, the process fluid, including the crushed particulates, may also be routed via the conduit 44 to the upper end chamber 60, wherein the process fluid is directed to the pump bearings located within the upper end chamber 60. As the fluid circulates throughout the upper end chamber 60, a portion of the process fluid may be directed, via conduit 38, to join the separated multiphase process fluid from conduit 36. Accordingly, the joining of flows from conduits 36 and 38 may be considered a makeup or re-circulation flow within the fluid communication circuit.

In addition, barriers between the inlet chambers 46 and 48 may be configured to enable leaks 64 and 66, wherein the process fluid may be configured to leak from the end chambers 60 and 62 into the inlet chambers 46 and 48. Specifically, leaks 64 and 66 are some of the portion of separated multiphase process fluid that is utilized to lubricate the pump bearings and, therefore, may include reduced size particulates as compared to the process fluid flow entering the inlet chamber 45. Accordingly, the leaks 64 and 66 in the barriers may enable the process fluid with reduced concentrations and size of particulates to improve flow within the inlet chambers 46 and 48, along the rotor screws, and to the outlet chamber 54. For example, the process fluid including reduced particulates, may stir up or reduce a settling of particulates within the incoming flow of process fluid 45 by mixing with, and diluting, the increased particulate fluid 45 entering the inlet. Alternatively, in a configuration without leaks 64 and 66, the incoming flow 45 of process fluid may include a large amount of particulates that may settle within inlet chambers 46 and 48, thereby impairing fluid flow between the inlet chambers 46 and 48 and outlet chamber 54. Further, the settling and/or buildup of particulates within the inlet chambers may cause breakdowns or require maintenance within the screw pump system 10. As may be appreciated, the industrial environments where screw pumps may be used emphasize a need for minimum downtime and maintenance. Accordingly, the leaking of reduced particulate and particulate size process fluid via leaks 64 and 66 improve process fluid flow throughout the twin screw pump 22 while reducing maintenance. Further, the makeup or compensation of process fluid via combined flow 42 into the lower end chamber 62 may enable a steady flow or compensation of fluid to account for the leaks 64 and 66 within the fluid circuit.

The screw pump system 10 may also include a pressure reducer 68 configured to be a part of the fluid flow path from the separator 32 to the end chamber 62. As illustrated, the pressure reducer 68 may be coupled separator 32, wherein the pressure reducer 68 enables a reduction of pressure as the fluid flows along conduits 36 and 42 into the end chamber 62. Moreover, the pressures within the twin screw pump 22 are managed to control fluid flow within the circuit. For example, the pressure within the outlet chamber 54, $P_1$, may be significantly greater than the pressure within the inlet chambers 46 and 48, $P_2$. This increase in pressure, from $P_2$ and $P_1$, is caused by the pumping action of the twin screws. In addition, the pressure within the end chambers 60 and 62, $P_3$, may be slightly greater than the pressure within the inlet chambers 46 and 48, $P_2$. This pressure difference between $P_3$ and $P_2$ may contribute to leaks 64 and 66. The pressure $P_1$ may be significantly greater than the pressure $P_3$, causing a need for the pressure reducer 68 to be located between the separator 32 and end chambers 60 and 62 within the fluid flow circuit. The pressure reducer 68 may be of any suitable type, such as a recirculation valve, a fixed geometry orifice plate, and so forth.

Figure 4:
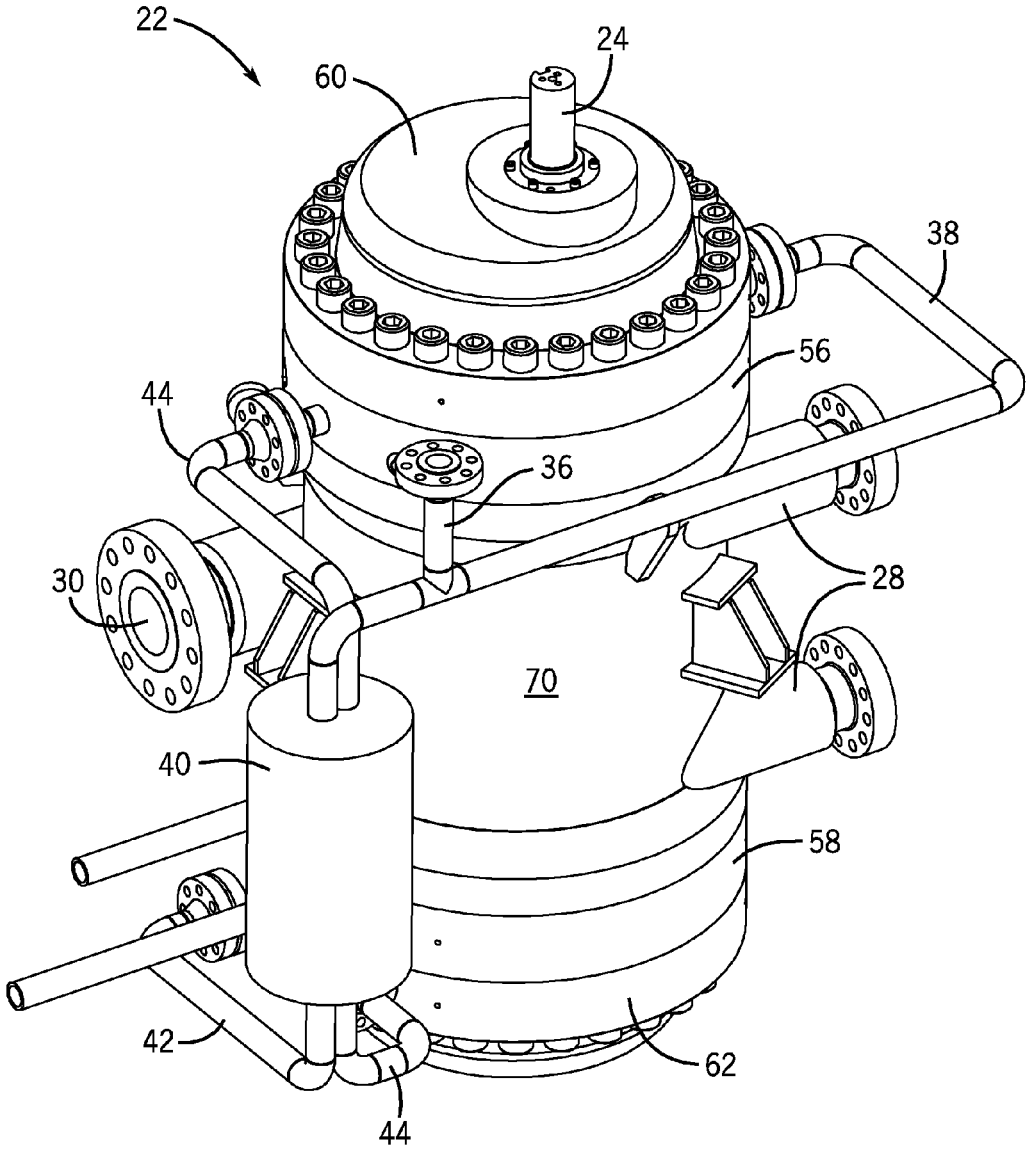
FIG. 4 is a detailed perspective view of a screw pump system, as shown in FIG. 1, in accordance with an embodiment of the present technique.

FIG. 4 is a detailed perspective view of an embodiment of the twin screw pump 22. In the embodiment, the twin screw pump 22 includes upper end chamber 60 and lower end chamber 62. The driving rotor shaft 24 is configured to enter the upper end chamber 60 to drive the screw rotors. In addition, the upper end chamber 60 is coupled to the upper radial bearing flange 56. Similarly, the lower end chamber 62 is coupled to the lower radial bearing flange 58. The bearing flanges 56 and 58 are each coupled to a central pump casing cover 70 which may contain the inlet chambers 46 and 48, as well as the outlet chamber 54. The inlet chambers 46 and 48 may be coupled to fluid inlets 28 which route the multiphase process fluid from the sub-sea well or other fluid supply unit. As will be discussed in detail below, the fluid inlets 28 are tangentially located with respect to the cylindrical central pump casing 70. Accordingly, the fluid inlets 28 swirl the process fluid intake, thereby agitating and mixing the particulates within the process fluid to prevent settling and buildup of particulates in the inlet chambers 46 and 48. The fluid outlet 30 is coupled to the outlet chamber 54 and is configured to direct the process fluid to the separator 32. Further, conduits, including conduits 36, 38, 42 and 44 may be configured to direct the process throughout the twin screw pump 22 to lubricate the screw pump components and direct the multiphase process fluid to a downstream unit.

Figure 5:
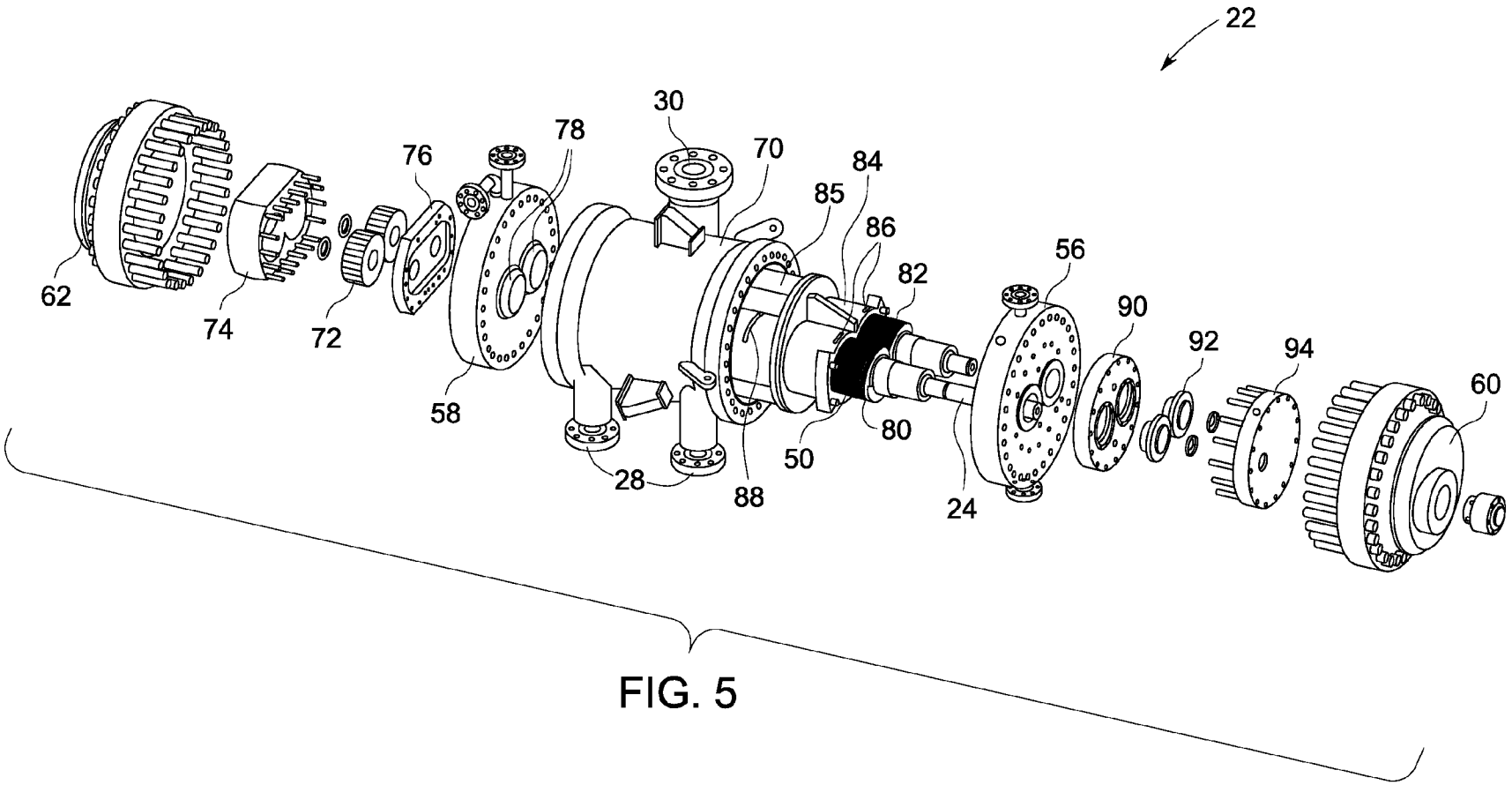
FIG. 5 is a detailed exploded view of a screw pump system, as shown in FIG. 4, in accordance with an embodiment of the present technique.

FIG. 5 is a detailed exploded view of the twin screw pump 22. As depicted, the twin screw pump 22 contains end chambers 58 and 60, as well as a central pump casing cover 70. In addition, gears 72 may be located inside a gear housing 74, which is located within the lower end chamber 62. As previously discussed, the gears 72 may be configured to grind particulate matter as process fluid flows through the gears to reduce the size of the particulates. A gear plate 76 is located within the lower end chamber 62 and may be coupled to the gear housing 74 and lower radial bearing flange 58. Rotor shrouds 78 may be coupled to the lower radial bearing flange 58. The rotor shrouds 78 may be configured to allow rotor shafts to rotate within the shrouds and enable a leak of process fluid from the lower end chamber 62 to the inlet chamber. The rotor shrouds 78 may be of certain geometry with clearances to enable a controlled leak to the inlet chamber 46. As will be discussed in detail below, the upper chamber 60 may also include rotor shrouds to enable a controlled leak to inlet chamber 48.

The drive shaft 24 may be coupled to a drive rotor 80 which is configured to drive a driven rotor 82, wherein the rotors 80 and 82 are disposed within rotor shrouds 78 and are each coupled to the gears 72. Accordingly, the driven rotor 82 is mechanically driven by the rotation of the gears 72 which is initiated by the rotational output from the driving rotor 80 and the shaft 24 that is coupled to motor 26. The drive rotor 80 and driven rotor 82 may be referred to as rotors, screws, threads or a combination thereof, which are meshed together and rotate to drive a fluid through the pump 22. In addition, the twin screw pump 22 includes a pump liner 84 within the central pump casing cover 70. The pump liner 84 may be disposed around the rotors 80 and 82 and may flex to prevent binding of the pump liner 84 to the screws during a pumping process. In addition, the pump liner 84 is adjacent to and coupled to the bulkhead 50 which separates the outlet chamber 54 and inlet chambers 46 and 48. The pump liner 84 may include a slot 86 which may be located within the inlet chamber 46 and/or 48 to enable the process fluid to flow into the rotor threads, thereby enabling a pumping. Further, rotor liner 85 may also include slot 88 which enables the pump process fluid to flow out of the pump liner 84 to the outlet chamber 54 and through the fluid outlet 30. The rotors 80 and 82 include shafts that pass the upper radial bearing flange 56, thrust bearing plate 90 and collars 92. An upper thrust bearing plate 94 may couple to the thrust bearing plate 90, thereby encompassing the collars 92 and ends of the rotors 80 and 82. Accordingly, the thrust bearing plate 90, collars 92 and thrust bearing plate 94 may form an upper bearing set in the end chamber 60, which may be lubricated by the re-circulated process fluid.

Figure 6:
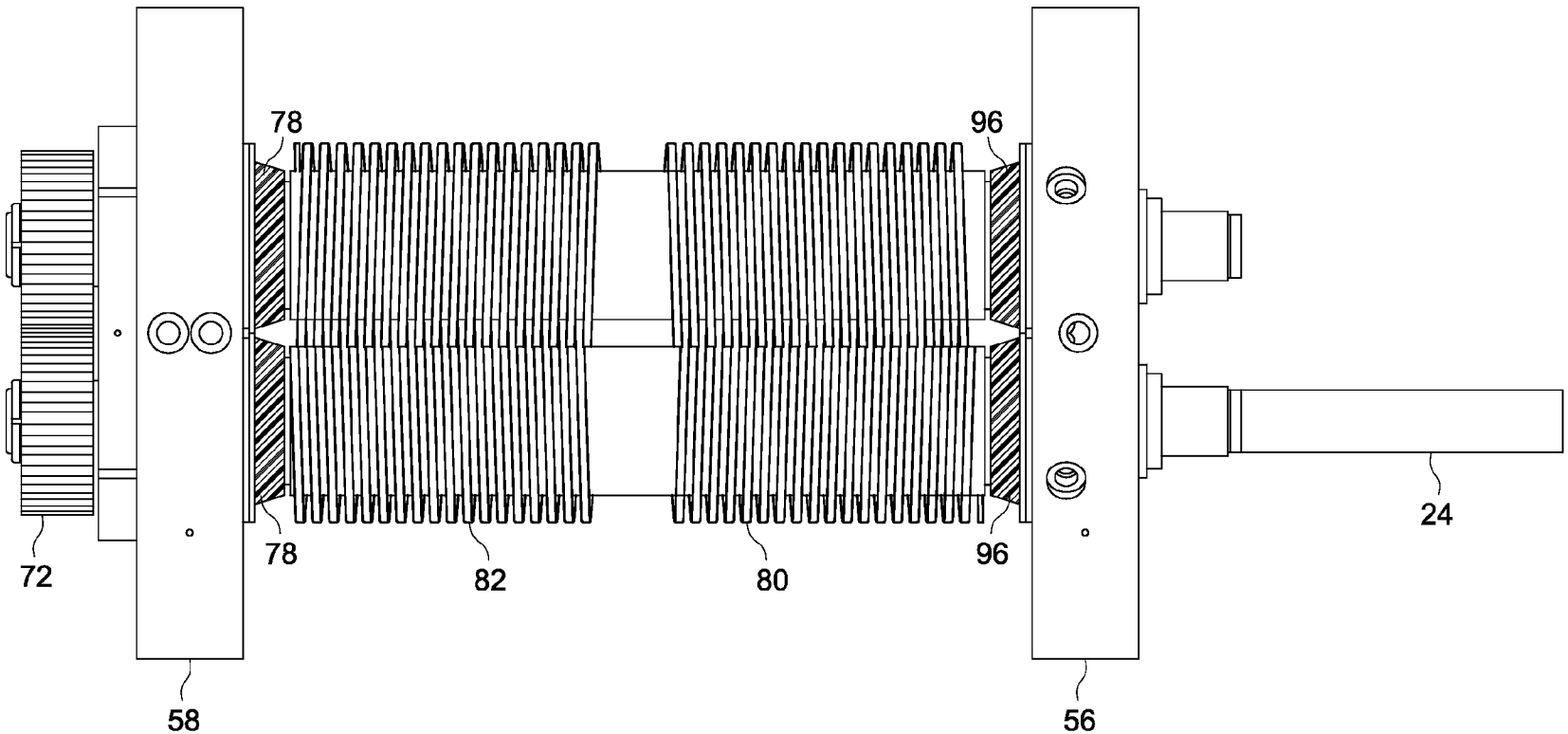
FIG. 6 is a detailed side view of components within a screw pump system, including rotor screws, gears, and rotor shrouds, in accordance with an embodiment of the present technique.

FIG. 6 is a detailed side view of the embodiment of components included in the twin screw pump 22. As depicted, the rotors 80 and 82 may be coupled to gears 72 which may be located at the ends of each of the rotor shafts. The gears 72 may be configured to intermesh, thereby driving the driven rotor 82 by a rotational and mechanical output of the drive rotor 80. Further, the gears 72 are configured to reduce particulate matter and process fluid and pump the process fluid throughout the twin screw pump 22. As the process fluid is pumped throughout the twin screw pump 22, the process fluid may leak through an upper rotor shroud 96 as well as the lower rotor shroud 78. Accordingly, the process fluid that leaks through rotor shrouds 78 and 96 may include reduced particulate content and size, thereby enabling the leaked process fluid to stir up and reduce a settling of particulates within the inlet chambers 46 and 48. As previously discussed, the screw pump system 10 may be configured to direct process fluid to enable a lubrication of components, including pump bearings, and to enable the process fluid to enhance process fluid flow by reducing particulate size in re-circulated process fluid. Further, the re-circulated process fluid, including fluid directed by the conduit 42 may be utilized to make up or compensate for the leaks of process fluid into the inlet chambers 46 and 48. Alternatively, other mechanisms may be used to leak the process fluid from end chambers 60 and 62 into the central pump casing cover 70. For example, one-way valves that are opened via pressure differentials and/or conduits may be utilized to direct or leak process fluid to chambers within the central pump casing cover 70. As such, the fluid entering pump casing cover 70 is configured to stir up or agitate fluid entering the pump, thereby reducing a settling of particulates.

Figure 7:
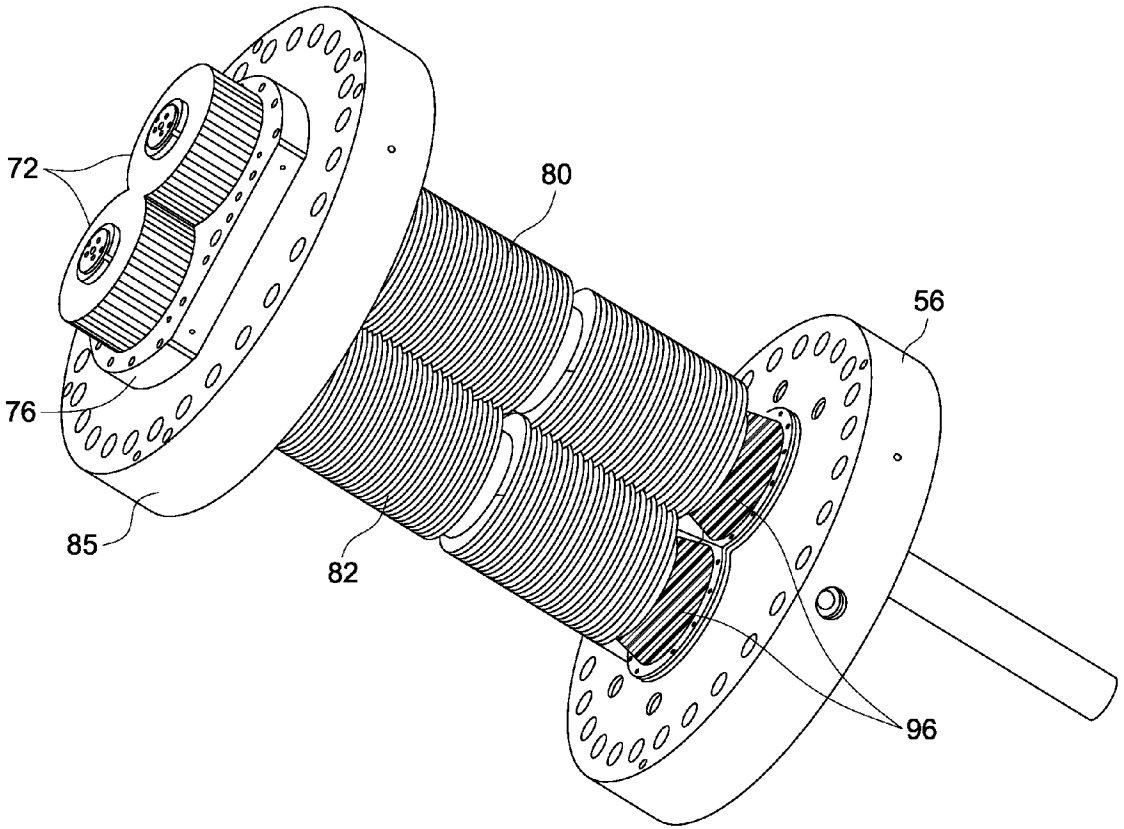
FIG. 7 is a detailed perspective view of certain components within a screw pump system, as shown in FIG. 6, in accordance with an embodiment of the present technique.

FIG. 7 is a detailed perspective view of an embodiment of components included in the twin screw pump 22. As depicted, drive rotor 80 and driven rotor 82 are intermeshing, where threads disposed on rotor shafts interlock to drive a process fluid from the inlet chambers 46 and 48 near the peripheral portions of the rotors to an outlet chamber 54, located near the center of the rotors. In addition, gears 72 are each coupled to an end of rotors 80 and 82 to crush particulates and time the rotation of the rotors. The gears 72 are configured to crush or grind particulates within the process fluid, thereby enabling the process fluid to lubricate bearings that are coupled to each end of the rotors 80 and 82. As depicted, the pump bearings are configured to support and enable rotation of the rotors 80 and 82, thereby enabling the process fluid to flow smoothly through the screw pump system 10. In an embodiment, the gears 72 may be comprised of a suitable durable material. For example, the gears 72 may be comprised of cemented carbide, such as a cemented tungsten carbide, wherein the gears 72 are formed and configured to grind particulate matters within the process fluid without erosion or destruction of the gears 72 during a grinding process. The teeth of each of the gears 72 may contact one another where two teeth from each gear are in contact, causing a high stress contact to crush particulates in the process fluid, Additionally, the gears 72 may be straight gears or another suitable geometry.

The twin screw pump 22 also includes the rotor shroud 96 which may be coupled to an end of the rotors 80 and 82 and may be configured to enable a leak of reduced particulate process fluid into the inlet chambers 46 and 48. After the gears 72 have crushed particulates within the process fluid, the gears may be configured to pump the process fluid to lubricate pump bearings, wherein the process fluid is then leaked via rotor shrouds 78 and 96 into the inlet chambers 46 and 48, thereby reducing a settling of particulates to improve a flow of process fluid.

Figure 8:
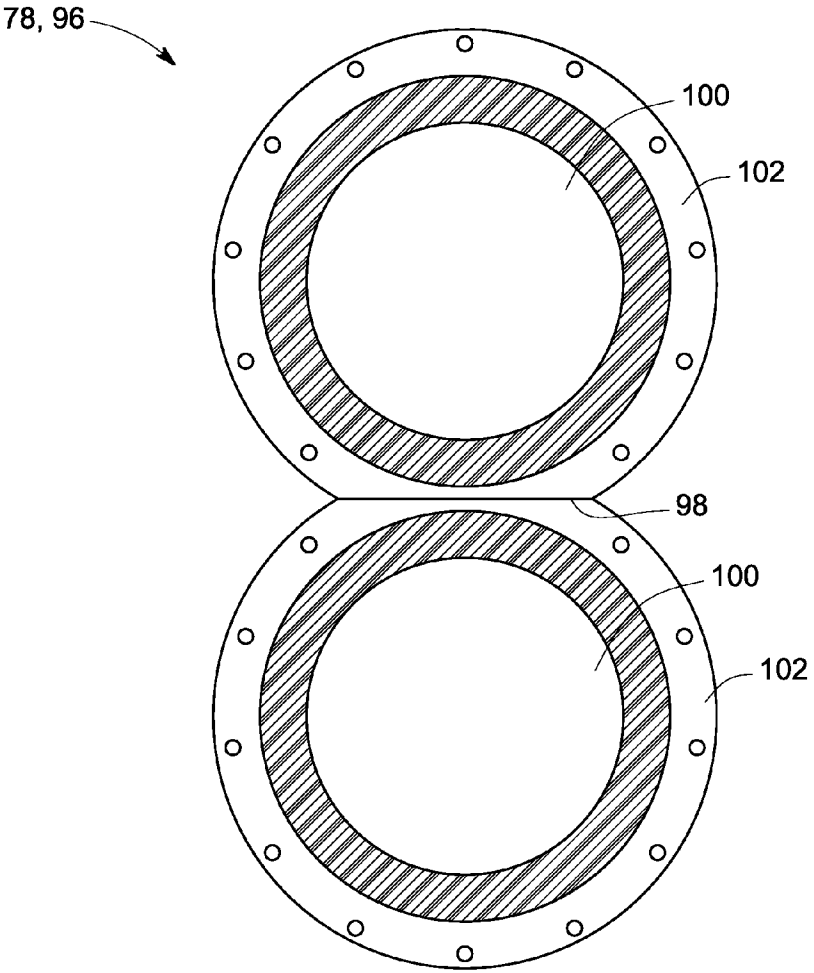
FIG. 8 is a detailed end view of rotor shrouds within a screw pump system, in accordance with an embodiment of the present technique.

FIG. 8 is a detailed end view of an example of the rotor shrouds 78 and 96. Rotor shrouds 78 and 96 are identical in structure and design and may each be placed on an end of rotors 80 and 82. Further, rotor shrouds 78 and 96 may be composed of two separate components joining at a joint 98, or may be composed of a single component wherein the two circular structures are part of a single overall member which may be cast or formed by any suitable means. Further the rotor shrouds 78 and 96 may be composed of any durable material, such as stainless steel. The rotor shrouds 78 and 96 including a pair of cylindrical openings 100, which are configured to enable each of the rotor shafts to pass through the shrouds. Accordingly, the openings 100 are configured to enable fluid communication between end chambers 60 and 62 and the chambers within central pump casing cover 70. The leaking of process fluid from end chambers 60 and 62 may be controlled by tolerances and spacing between components, as well as managing the pressures within the system. The rotor shrouds 78 and 96 may also include flanges 102 which are used to attach the rotor shrouds to the bearing flanges 56 and 58. The rotor shrouds 78 and 96 may be coupled via screws, welds, or other suitable coupling mechanisms to the radial bearing flanges 56 and 58.

Figure 9:
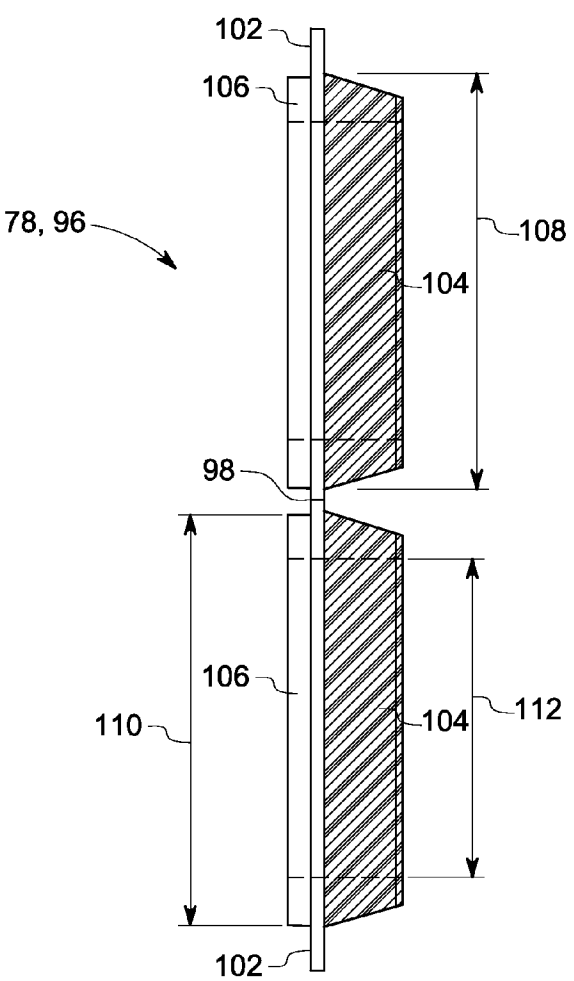
FIG. 9 is a detailed side view of rotor shrouds within a screw pump system, as shown in FIG. 8, in accordance with an embodiment of the present technique.

FIG. 9 is a side view of the rotor shrouds 78 and 96. The rotor shrouds 78 and 96 include protruding portions 104 that protrude into inlet chambers 46 and 48 of the twin screw pump 22. In addition, the rotor shrouds 78 and 96 also include protruding portions 106 which protrude into the radial bearing flanges 56 and 58, thereby enabling the flanges 102 to be coupled to an interior surface of the radial bearing flanges. The protruding portions 104 may have a diameter 108 of approximately 14.5 inches (36.8 cm). Further, the protruding portions 106 may have a diameter distance 110 of approximately 14.25 inches (36.2 cm). The shroud openings may have an inner diameter distance of 112 of approximately 11 inches (27.9 cm). It should be understood, however, that other dimensions and dimensional relationships may be used. As depicted, the rotor shrouds 78 and 96 may be configured to enable a leaking of process fluid, with a reduced particulate size and content, into chambers within the pump casing 70 to dilute particulates from incoming process fluid and reduce a settling of particulates within the inlet chambers 46 and 48.

Figure 10:
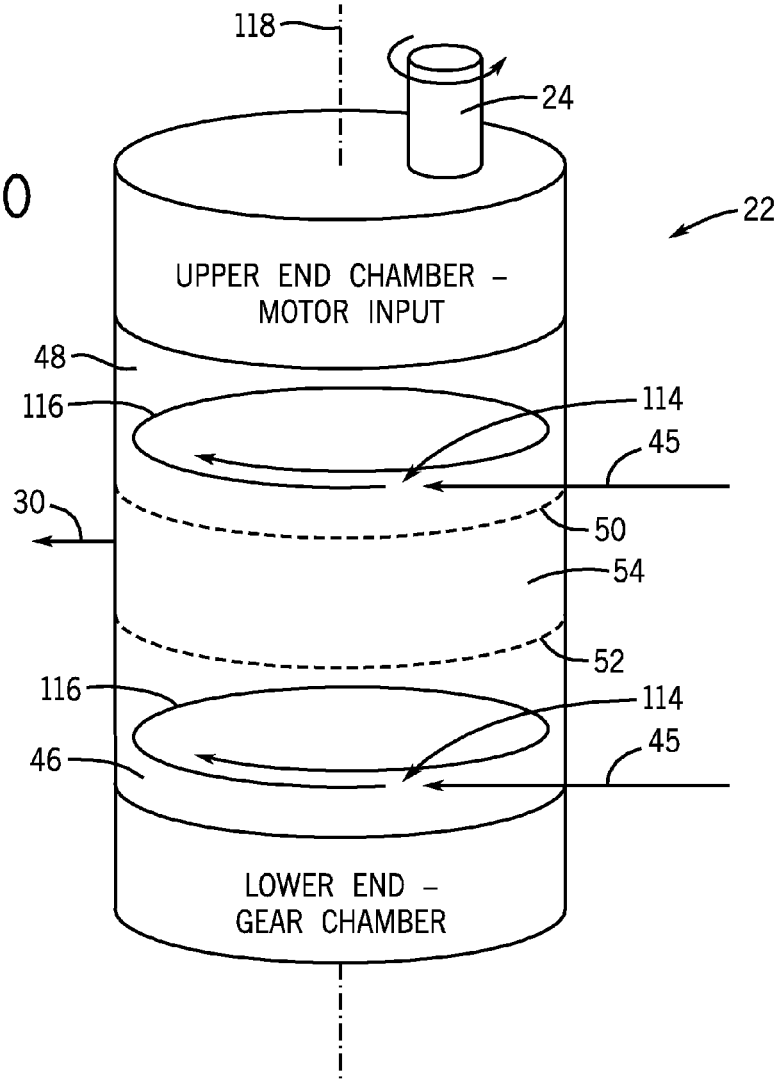
FIGS. 10 and 11 are schematic diagrams of a screw pump system including a configuration to swirl the multiphase process fluid as it enters inlet chambers of the screw pump to prevent settling of particles, in accordance with an embodiment of the present technique.

FIG. 10 is a schematic diagram of an example of the twin screw pump 22, including inlets located on inlet chambers 46 and 48. The inlets 28 (also shown in FIG. 4) are configured to direct a process fluid inlet flow 45 that is tangential in relation to inlet chambers 46 and 48. Accordingly, a tangential location 114 within the cylindrical inlet chambers 46 and 48 enables the process fluid to swirl about the chambers, as shown by flow patterns 116. As depicted, the flow patterns 116 swirl around a central axis 118 and the inlet chambers 46 and 48, thereby agitating particulates within the process fluid to improve fluid flow and reduce a settling of particulates within the pump chambers. By improving the process fluid flow and reducing particulate settling, the tangential inlet locations 114 reduce wear and tear and improve efficiency in pumping performance of the twin screw pump 22. Accordingly, the process fluid flows through rotors 80 and 82 as the rotors turn, thereby pumping the process fluid from inlet chambers 46 and 48 to outlet chamber 54 and out of the chambers as shown by outlet flow 30.

Figure 11:
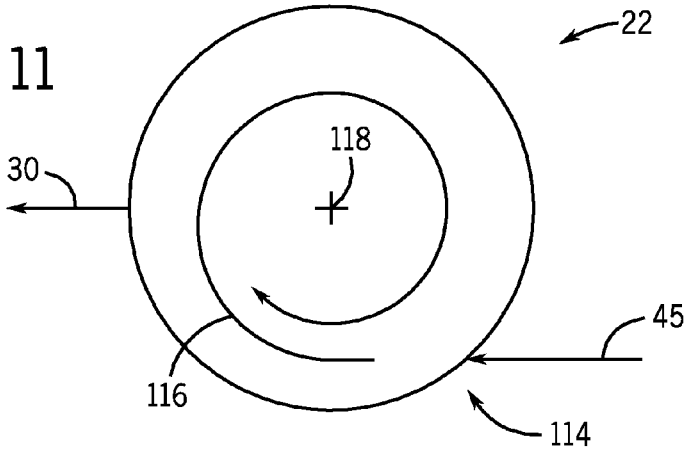

FIG. 11 is a top view of the schematic diagram shown in FIG. 10. As depicted, the tangential location 114 of the process fluid inlet flow 45 enables a swirling flow 116 about axis 118. The improved flow characteristics and reduce settling provided by the tangential inlet of the inlet flow 45 enables an improved flow of process fluid throughout the screw pump system 10.

Technical effects of the invention include reduced wear and maintenance of screw pump components. Further, the embodiments also lead to simplified assembly and maintenance of screw pump systems by eliminating dedicated lubrication systems and components. Moreover, the disclosed embodiments may improve system performance by managing the pressures through the system to control fluid flow.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A pump system, comprising:

a pair of inlet chambers with an inlet pressure disposed inside a pump casing;

an outlet chamber disposed between the inlet chambers inside the pump casing;

a plurality of rotors disposed inside the inlet chambers and outlet chamber, configured to direct a multiphase process fluid from the inlet chambers to the outlet chamber, wherein the outlet chamber has an outlet pressure and is configured to direct the multiphase process fluid to a separator;

end chambers coupled to flanges on each end of the pump casing, each end chamber containing a pump bearing and having a pump bearing pressure, wherein the pump bearings are configured to be lubricated by a portion of a separated multiphase process fluid from the separator; and wherein some of the portion of the separated multiphase process fluid is configured to leak from the end chambers through the flanges to the inlet chambers.

2. The system of claim 1, wherein the pump bearing pressure is greater than the inlet chamber pressure.

3. The system of claim 1, comprising a rotor shroud disposed about each rotor, and coupled to a flange.

4. The system of claim 3, wherein the rotor shroud comprise an elastomeric material.

5. The system of claim 1, wherein a plurality of gears are coupled to an end of each of the rotors inside one of the end chambers, wherein the plurality of gears are configured to grind the particulate matter in the multiphase process fluid by flowing the particulates through the rotating gears so as to reduce a size of the particulate matter.

6. The system of claim 5, wherein the plurality of gears are configured to pump the multiphase process fluid through the system to lubricate the pump bearings.

7. The system of claim 1, comprising a bulkhead that separates the inlet chambers and the outlet chamber.

* * * * *